US006513407B1

(12) United States Patent
Higgins

(10) Patent No.: US 6,513,407 B1
(45) Date of Patent: Feb. 4, 2003

(54) INTEGRATED LEVER ASSEMBLY

(75) Inventor: Kenneth Terry Higgins, Metamora, MI (US)

(73) Assignee: Lattimore & Tessmer, Inc., Southfield, MI (US)

( * ) Notice: Subject to any disclaimer, the term of this patent is extended or adjusted under 35 U.S.C. 154(b) by 51 days.

(21) Appl. No.: 09/668,619

(22) Filed: Sep. 22, 2000

Related U.S. Application Data

(60) Provisional application No. 60/155,999, filed on Sep. 24, 1999.

(51) Int. Cl.[7] ..... G05G 1/14

(52) U.S. Cl. ..... 74/560

(58) Field of Search ..... 74/512–514, 560–562, 74/594.1; 72/55, 367

(56) References Cited

U.S. PATENT DOCUMENTS

| | | | | | |
|---|---|---|---|---|---|
| 3,744,340 | A | * | 7/1973 | Peterson | 74/560 |
| 4,356,740 | A | | 11/1982 | Kubo et al. | 74/560 |
| 4,744,237 | A | | 5/1988 | Cudini | 72/367 |
| 4,829,803 | A | | 5/1989 | Cudini | 72/367 |
| 5,044,223 | A | | 9/1991 | Mizuma et al. | 74/512 |
| 5,070,717 | A | | 12/1991 | Boyd et al. | 72/55 |
| 5,074,163 | A | | 12/1991 | Baumann | 74/512 |
| 5,078,024 | A | | 1/1992 | Cicotte et al. | 74/512 |
| 5,435,205 | A | | 7/1995 | Seksaria et al. | 74/560 |
| 5,493,937 | A | * | 2/1996 | Edwards | 74/594.1 |
| 5,575,181 | A | | 11/1996 | Baumann | 74/512 |
| 5,799,524 | A | * | 9/1998 | Schafer et al. | 72/55 |
| 5,924,336 | A | * | 7/1999 | Richardson | 74/594.1 |
| 6,305,201 | B1 | * | 10/2001 | Ghiran et al. | 72/55 |

FOREIGN PATENT DOCUMENTS

| | | |
|---|---|---|
| DE | 9419505 | 11/1994 |
| GB | 2325511 | 11/1998 |

OTHER PUBLICATIONS

*Increasing The Hydroforming Knowledge Base* Automotive Engineering International / Feb. 2000, pp 19, 20–22.

* cited by examiner

*Primary Examiner*—Chong H. Kim
(74) *Attorney, Agent, or Firm*—Harness, Dickey & Pierce, P.L.C.

(57) ABSTRACT

A lever assembly is disclosed which is formed from a one piece, longitudinally oriented, hollow metal tubular member integrally formed with a first end, a second end, and a central section in between. A clevis is integrally formed in the first end. The clevis portion has a pair of spaced apart walls and an integral projection extending from each of the spaced apart walls. Additionally, the assembly has an integrally formed foot engaging portion extending from the second end.

18 Claims, 3 Drawing Sheets

INTEGRATED LEVER ASSEMBLY

This application claims the benefit of Provisional Application No. 60/155,999, filed Sep. 24, 1999.

BACKGROUND OF THE INVENTION

The present invention is directed to a control lever assembly for a vehicle, and more particularly to using a hydroformed tubular member.

Lever assemblies are used in conventional motor vehicles for brakes, clutches, accelerators and emergency brakes. Many of these lever constructions are fabricated assemblies and typically consist of a bent steel bar with apertures and bushings at one end for receiving a pin for pivotal attachment to the vehicle and a stamped sheet metal foot plate at the other end. A foot pad, bushing and bracketry are attached to the steel bar to form a fabricated assembly. Additionally, the lever assembly may have tabs welded to it for the actuation of switches, the attachment of return springs and other similar devices. Examples of lever assemblies are disclosed in U.S. Pat. Nos. 4,356,740, 5,044,223, and 5,078,024. These prior art assemblies are relatively heavy, complex and expensive to manufacture and require welding or equivalent joining operations which can reduce the durability and reliability of the lever assembly.

A lightweight pedal mechanism formed by hydroforming is disclosed in U.S. Pat. No. 5,435,205. The pedal mechanism is made from a single length of extruded, thin-walled, round cross-section aluminum tubing. It consists of an upper clevis portion, a central portion and a lower foot engaging section. The clevis section has opposed apertures for receiving a bushing. Directly above the aperture is a cut-out section in communication with the extreme end of the side walls and with the apertures in the side walls. The bushing has an outer diameter with grooves or notches. This prevents the bushing from moving out of the clevis section in a radial direction. The foot engaging section is formed from a lower section that is bent in a plane that is about at a right angle relative to the length of the main body portion. Because the foot engaging section extends at a right angle relative to the main body portion, the pedal is not compact. Also, the bushing must be inserted separately into the apertures in the clevis section.

This design has not been extensively adopted for motor vehicle use in spite of its purported advantages. Thus, there is still a need for an improved lever assembly that overcomes the limitations of the above design and provides a lightweight, inexpensive, compact, easy to manufacture, and integrated, longitudinally oriented lever assembly.

SUMMARY OF THE INVENTION

The present invention provides a lever assembly consisting of a one piece metal tubular member having an integrally formed first end, an integrally formed opposite second end, and an integrally formed center section between the first and second ends, a free end integrally formed of the second end and a clevis portion integrally formed within the first end. The clevis portion has a pair of spaced apart walls and an integral projection extending away from one of the pair of spaced apart walls.

It is an object of the present invention to provide a lever assembly which can be used for a variety of applications, including brakes, clutches, accelerator devices or emergency brakes in a vehicle, and which is light weight, inexpensive, easy to manufacture and integrates a jointless projection to receive and retain a bushing therein.

It is a further object of the present invention to provide a longitudinal lever assembly which is formed by hydroforming or a similar process and in which the integral projections are hydropierced to form an aperture which receives a bushing pin therein and which is inexpensive and easy to manufacture.

It is still a further object of the present invention to provide a longitudinal lever assembly with a central portion which has an integral projection and a structural configuration which permits the integration of switches, gauges, mounting devices or actuator rods and yet is easy and inexpensive to manufacture.

It is still another object of the present invention to provide a lever assembly with an integral projection and a pedal section with a pair of spaced apart portions forming a planar surface, an intermediate portion which is below the planar surface supporting the spaced apart portions and which is easy and inexpensive to manufacture.

These and other objects of the invention will become apparent from a consideration of the following description and the appended claims when taken in connection with the accompanying drawings.

DETAILED DESCRIPTION OF THE PREFERRED EMBODIMENT

The lever assembly according to the present invention is designated by the numeral 100 as shown in FIGS. 1–6. The assembly 100 is made from a single length of an extruded, light weight, hollow, thin metal tubing 10. Optionally, the tubing 10 is roll formed with a fused joint to produce a single, thin wall metal tubing of any exterior shape. The tubing 10 may be rectangular in exterior shape in cross-sectional view after hydroforming or, optionally, it is square $\mathbf{10}^{I}$, I-Beam $\mathbf{10}^{II}$, triangular $\mathbf{10}^{III}$, elliptical $\mathbf{10}^{IV}$, round $\mathbf{10}^{V}$, polygonal $\mathbf{10}^{VI}$, or any other similar outer wall or exterior shape after hydroforming that is satisfactory for the intended use. The tubing 10 is preferably made of steel, however, other metals such as aluminum, stainless steel alloy, magnesium, or other similar materials may also be used in practicing the present invention.

The tubing 10 is subjected to a hydroforming process which is well known to those skilled in the art. In the hydroforming process, hydraulic pressure above 0.5 MPa to 12 MPa pressure is applied to the inside of the tubing 10 to deform the walls of the tubing outwardly between mating surfaces of female die sections causing the tubing to take on the same configuration as that of the female dies and to feed the metal into a deformation zone to form integral parts of complex shapes. Such a process is shown in U.S. Pat. Nos. 5,435,205, 5,070,717 and 4,829,803.

Figure 1:
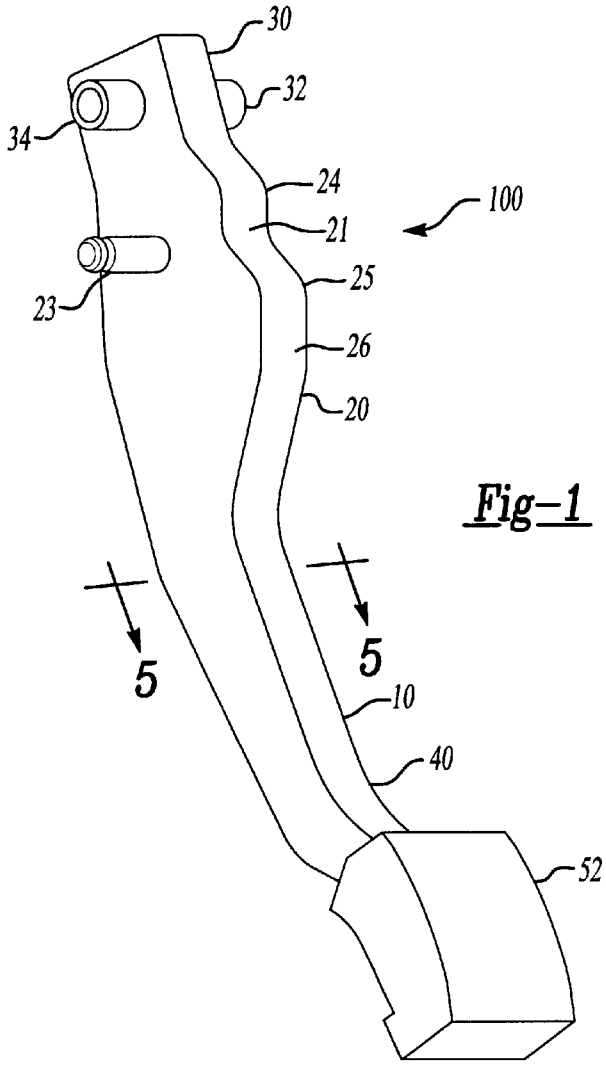
FIG. 1 is a perspective view illustrating the lever assembly of the present invention after it has been formed.
Figure 2:
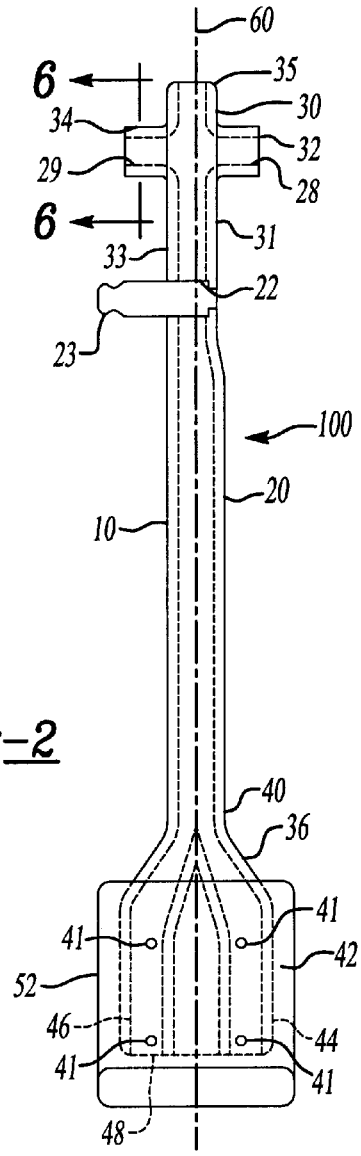
FIG. 2 is a frontal view of the lever assembly formed according to the present invention.

The tubing 10 of the present invention has a central portion 20, an upper portion 30, and a foot engaging portion 40 which are formed along the longitudinal axis 60 as shown in FIGS. 1 and 2. The upper portion 30 and central portion 20 are formed by a generally parallel but spaced apart wall through its longitudinal axis length until just before the foot engaging portion 40 where the walls of the lower portion 36 are expanded, as will be discussed more fully below. Optionally, any one or more of the portions 20, 30, 40 may be offset from the longitudinal axis 60. Those skilled in the art will appreciate that the preferred embodiment is described and illustrated herein as a parallel but spaced apart cross-section along the longitudinal axis 60, as shown in the frontal view in FIG. 2. The design requirements encountered in utilization of the lever assembly according to the invention may be satisfied with modifications to this cross-sectional configuration as dictated by the specific application to optionally include diverging and converging wall sections along its longitudinal axis 60.

Figure 3:
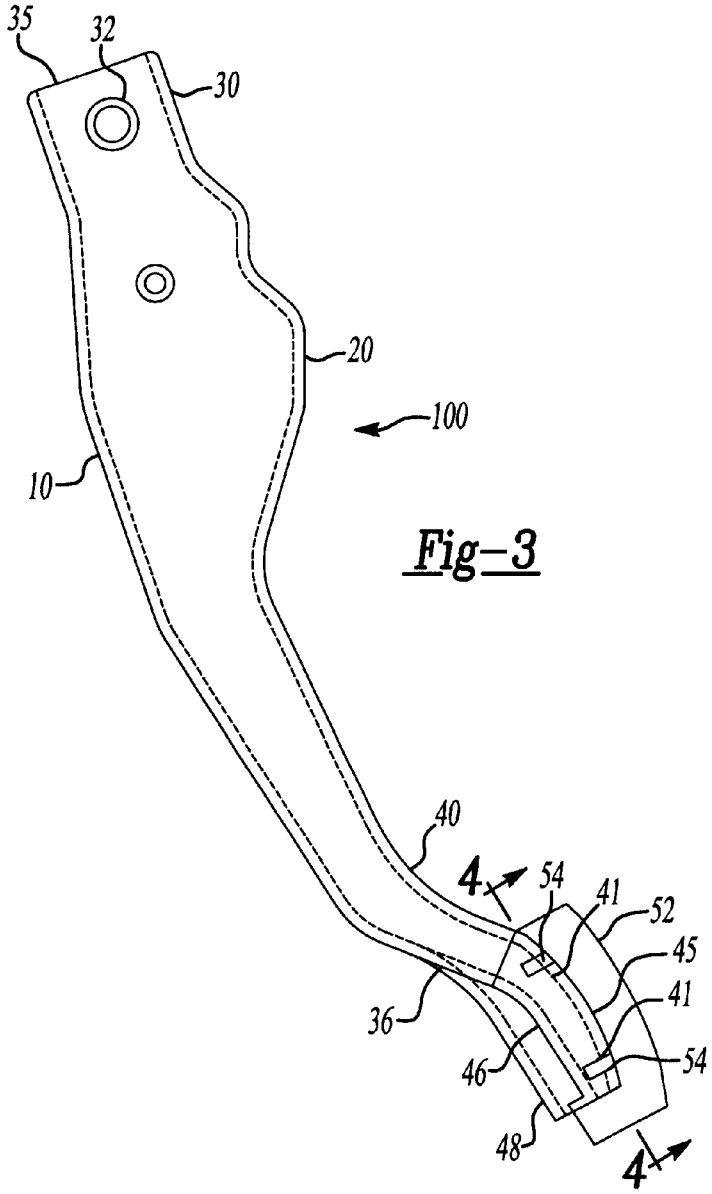
FIG. 3 is a side view of the lever assembly formed according to the present invention.
Figure 4:
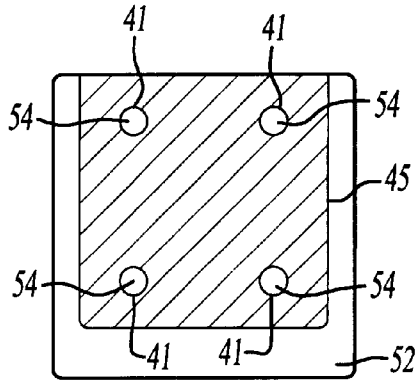
FIG. 4 is a frontal view of the foot pad taken along lines 4—4 of FIG. 3.
Figure 5A:
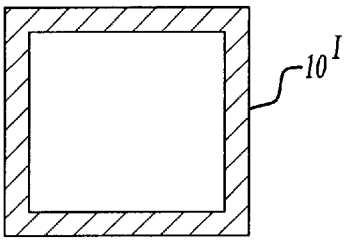
FIGS. 5 A–F are different cross-sectional views along lines 5—5 of FIG. 1.
Figure 5E:
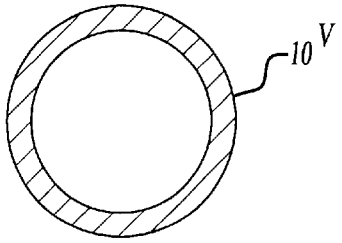
Figure 6C:
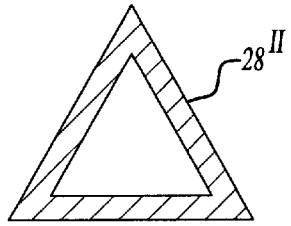
FIGS. 6 A–F are different cross-sectional views along lines 6—6 of FIG. 2.
Figure 5B:
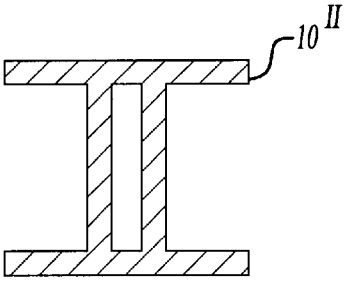
Figure 5F:
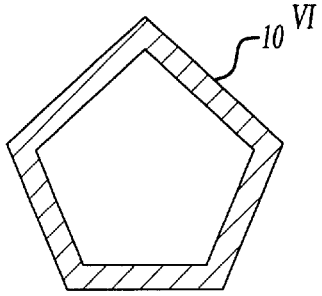
Figure 6D:
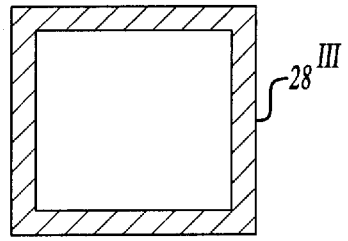
Figure 5C:
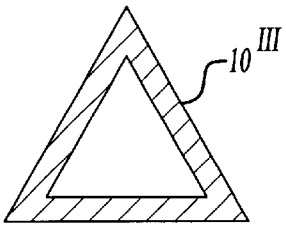
Figure 6A:
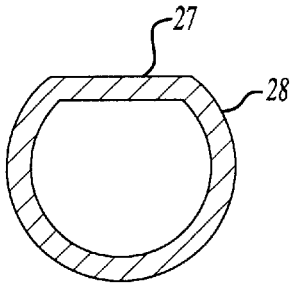
Figure 6E:
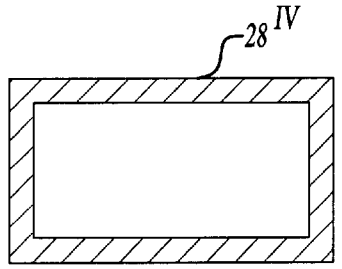
Figure 5D:
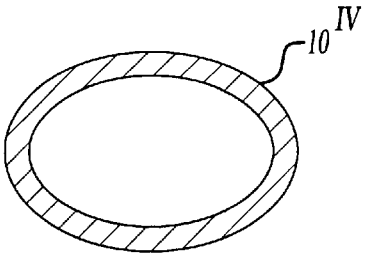
Figure 6B:
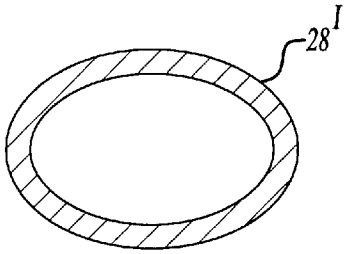
Figure 6F:
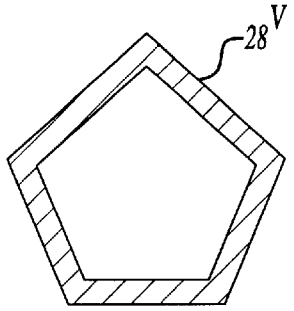

FIGS. 2 and 3 show the upper portion 30 having a pair of projections 32, 34 formed into the side walls 31, 33, respectively, below the clevis section 35 of the tubing 10. The projections 32, 34 are formed during the hydroforming process and optionally, could be hydropierced to form apertures 28, 29 in the projections 32, 34, respectively. The apertures 28, 29 are preferably each formed with an inner round surface or, optionally, with a flat portion 27 or each is formed with other irregular inner shapes, such as elliptical $28^{I}$, $29^{I}$, triangular $28^{II}$, $29^{II}$, square $28^{III}$, $29^{III}$, rectangular $28^{IV}$, $29^{IV}$, or polygonal $28^{V}$, $29^{V}$, to capture and provide orientation of the correspondingly outer surface shaped bushing pin member (not shown) when the bushing pin member is inserted therein. The projections 32, 34 also provide the bushing pin member with a substantial bearing surface which prevents deformation of the projections 32, 34 during use when the lever assembly is installed in a motor vehicle. The top 35 of the upper portion 30 receives a clevis section (not shown) which is connected to the appropriate control member (not shown).

In the upper portion 30, shown in FIGS. 2 and 3, the tubing 10 is formed into a substantially rectangular, thin wall cross-sectional configuration. Below the projections 32, 34, the central portion expands into an irregular shape in the side view, as shown in FIG. 3, while maintaining a spaced apart configuration in frontal view, as shown in FIG. 2. The central portion 20 has an actuator aperture 22 formed by hydropiercing two opposite ends on the spaced apart walls of the central portion 20 to form round holes. Optionally, the aperture 22 may be formed into an irregular shaped undersurface to capture and provide orientation for an actuator pin 23. The irregular shaped undersurface may also be an- inner diameter with a flat portion and, optionally, it may also include an elliptical, triangular, square, rectangular or polygonal shape. The central portion 20 also has contact surfaces 24, 25, 26 for mounting a device such as a switch, gauge or other monitoring unit as may be appropriate or required by the functions of the motor vehicle. The contact surfaces 24, 25 and 26, respectively, generally have planar portions 21 formed therein. Those skilled in the art will appreciate that the lever assembly 100 may optionally have other openings or connection points formed therein as required by the application.

As stated previously, below the central portion 20 of the tubing 10, the lower portion 36 is formed. The lower portion 36 is generally rectangular in cross-section in frontal view in FIG. 2, until the foot engaging portion 40. However, the lower portion 36 may be tapered or have divergent or convergent shapes as required by the structural requirements of the lever assembly 100.

As stated earlier, the foot engaging portion 40 which is part of the lower portion 36 is preferably formed by expanding the tubing 10 into a generally Y-shaped member 42. The Y-shaped member 42 has a first portion 44 and a second portion 46 spaced apart from the first portion 46. The first and second spaced apart portions 44, 46 form a flat planar portion 45. An intermediate portion 48 is formed on the opposite side of the flat planar portion 45 but extends in a supporting manner to provide structural support to the first portion 44 and the second portion 46, as shown in FIG. 3. The first portion 44 and the second portion 46 are preferably parallel to each other as shown in FIG. 2, although they may optionally diverge or converge depending on the structural requirements of the application. The portions 44, 46 provide the required rigidity for an elastomeric foot engaging pedal pad 52. The pedal pad 52 may be chemically engaged to the flat planar portion 45, such as by adhesive processes well known in the art or other similar methods suitable for the application. Alternatively, a plurality of holes 41 are formed in the flat planar portion 45 for purposes of engaging the pedal pad 52 mechanically to the foot engaging portion 40 for example as when the pedal pad has pins or projections 54 which are molded into the pedal pad 52. Those skilled in the art will recognize that the pins or projections 54 may be metal or plastic which, when inserted into the holes 41, secure the pad 52 either during the chemical engagement process or mechanically engage the pad 58 to the portion 45 if the adhesive process is not required. Pins 54 are of conventional construction permitting insertion of conical engaging surfaces, referred to as "Christmas Tree" pins, which are conical in shape with several coextending branches or alternatively, other suitable fasteners, into the holes 41 so as to secure the pedal pad to the flat planar portion 45. While the flat planar portion 45 is shown to be relatively smooth, alternatively, the portion 45 can be formed to include a plurality of regular surface ridges or a plurality of irregular surface ridges that frictionally engage the bottom of the operator's footwear during operation of the motor vehicle.

The dimensions of the finished product of the lever assembly 100, as shown in FIGS. 1–6, will depend on the dimensions of the tubing 10 and the requirements of the application. The dimensions will be tailored to optimize the structural performance of the lever assembly 100 for the applied loads which are transferred into the lever assembly 100 during its operation. In certain applications, the lever assembly may used in conjunction with actuating switches, gauges and monitoring devices (not shown). For example, the surface area of the central portion 20 and upper portion 30 may be designed to provide an adequate contact surface for the actuation of a switch, such as a brake light switch, for its operation.

The lever assembly 100 is made from thin walled, extruded tubing which reduces or eliminates welded ancillary parts or secondary aperture forming operations. This results in a lever assembly that is less expensive to manufacture due to its fewer processing steps.

In operation, the lever assembly 100 of the present invention is installed in a vehicle (not shown), preferably in position similar to that shown in FIG. 2. The hydroformed projections 32, 34 accept pivot bushing pin members in the apertures 28, 29, respectively. The assembly 100 has a central portion 20 which extends toward the operator and a foot engaging portion 40 of the lower portion 36 which projects towards the operator.

Those skilled in the art will appreciate that even though the hydroforming process has been described as preferable in forming the lever assembly 100, other similar tubular forming manufacturing processes such as by Thixomolding®, which is a registered trademark of Thixomat, Inc. of Ann Arbor, Mich., can be used in practicing the invention. Thixomolding® is the process of injection molding metal, such as eutectic magnesium or aluminum particles, to form metallic parts and is well known in the art.

As stated earlier, even though the invention has been described with a metal tube with an integral central portion 20 and an integral upper portion 30, both of which are formed from a longitudinally extending, generally rectangular, thin wall cross-sectional configuration, the tube 10 can be formed into other cross-sectional shapes such as I-beam, box square, triangular, oval, round or polygonal as dictated by the design requirements of the application, without departing from the scope of the invention.

While the invention has been described for a particular embodiment, it will be evident to those skilled in the art that numerous variations of the details may be made without departing from the spirit and teachings of the invention as defined in the appended claims.

What is claimed is:

1. A lever assembly for a vehicle comprising:

a one-piece, longitudinally extending, metal tubular member having an outerwall, an integrally formed first end, an integrally formed opposite second end, and an integrally formed center section between said first and second ends, said first end having a pair of spaced apart walls;

an integral projection extending from the surface of at least one of said pair of spaced apart walls; and said second end comprising a top surface and a structural support portion located below said top surface, said structural support portion further comprising a pair of spaced apart sections and an intermediate section in between said pair of spaced apart sections, said pair of spaced apart sections disposed between said top surface and said intermediate section.

2. A lever assembly as claimed in claim 1 further comprising:

at least one surface on said center section, said at least one surface being adapted to provide at least one mounting device.

3. A lever assembly as claimed in claim 1 wherein said pair of spaced apart sections are coplanar.

4. A lever assembly as claimed in claim 1 wherein said integral projection has an inner surface formed by pressurized fluid.

5. A lever assembly as claimed in claim 1 wherein said one-piece metal longitudinally extending tubular member is formed by a metal process selected from a group consisting of hydroforming and Thixomolding®.

6. A lever assembly as claimed in claim 1 wherein said metal member is selected from a group consisting of steel, aluminum, magnesium and stainless steel alloy.

7. A lever assembly as claimed in claim 1 wherein said one-piece metal tube is formed by pressure exceeding 0.5 MPa pressure.

8. A lever assembly as claimed in claim 4 wherein said integral projection has a flat portion on said inner surface.

9. A lever assembly as claimed in claim 1 wherein said metal tubular member is formed into an outer shape selected from a group consisting of rectangular, triangular, I-beam, box square, oval, round and polygonal.

10. A lever assembly adapted for use in vehicles, said lever assembly comprising:

a one-piece metal longitudinally extending tubular member having an integrally formed clevis portion disposed at a first end of said member, an integrally formed foot engaging portion disposed at a second end of said member and an integrally formed center portion disposed between said first end and said second end of said tubular member; and an integral projection extending traversely of the surface of said longitudinally extending tubular member, said integral projection having a portion forming an aperture and an inner surface;

wherein said second end being formed into a generally Y-shaped member, said Y-shaped member having a first portion, a second portion spaced apart from said first portion, a planar portion between said first portion and said second portion, and an intermediate portion opposite to said planar portion to provide structural support to said first and second spaced apart portions.

11. A lever assembly as claimed in claim 10 further comprising a pedal pad connected by engagement means to said Y-shaped member.

12. A lever assembly as claimed in claim 10 wherein said planar portion having a surface selected from a group consisting of a plurality of regular ridges and a plurality of irregular surface ridges.

13. A lever assembly as claimed in claim 10 wherein said center portion having an actuator aperture and contact surfaces for the actuation of a switch.

14. A lever assembly as claimed in claim 10 wherein said center portion having a portion forming an actuator aperture, said aperture having an inner surface being selected from a group consisting of round, oval, elliptical, triangular, square, rectangular, polygonal and a flat on an inner diameter.

15. A lever assembly as claimed in claim 10 wherein said tubular member is formed into an outer shape selected from a group consisting of rectangular, elliptical, triangular, I-beam, box square, oval, round and polygonal.

16. A lever assembly as claimed in claim 10 wherein said pressurized fluid process exceeds 0.5 MPa pressure.

17. A lever assembly as claimed in claim 10 wherein said integral projection having an irregular shaped inner surface formed by pressurized fluid.

18. A lever assembly as claimed in claim 10 wherein said pressurized fluid process is selected from a group consisting of hydroforming and Thixomolding®.

* * * * *